US006701650B1

(12) United States Patent
Cieciuch et al.

(10) Patent No.: US 6,701,650 B1
(45) Date of Patent: Mar. 9, 2004

(54) SIGN SUSPENSION SYSTEM

(75) Inventors: Cary A. Cieciuch, Stratford, CT (US); Henry Wilko, Westbury, NY (US)

(73) Assignee: Mechtronics Corporation, Stamford, CT (US)

( * ) Notice: Subject to any disclaimer, the term of this patent is extended or adjusted under 35 U.S.C. 154(b) by 0 days.

(21) Appl. No.: 08/657,246

(22) Filed: Jun. 3, 1996

Related U.S. Application Data

(63) Continuation-in-part of application No. 08/408,934, filed on Mar. 23, 1995, now Pat. No. 5,529,274.

(51) Int. Cl.[7] ..... G09F 7/00

(52) U.S. Cl. ..... 40/601; 40/617; 160/331; 248/329; 248/332

(58) Field of Search ..... 40/601, 617; 340/815.58, 340/815.6, 815.83; 248/317, 320, 327, 328, 329, 332, 338; 49/26, 28; 160/188, 331, 333, 338, 339

(56) References Cited

U.S. PATENT DOCUMENTS

| | | | | | |
|---|---|---|---|---|---|
| 423,873 | A | | 3/1890 | Kinney et al. | |
| 580,770 | A | | 4/1897 | Cashion | |
| 662,089 | A | | 11/1900 | Pettey | |
| 943,651 | A | | 12/1909 | Chandler et al. | |
| 1,471,454 | A | | 10/1923 | Dolan et al. | |
| 2,074,660 | A | | 3/1937 | Masoner | |
| 2,144,397 | A | | 1/1939 | Taddonio | |
| 3,154,870 | A | | 11/1964 | Hopp et al. | |
| 3,157,870 | A | | 11/1964 | Hopp et al. | |
| 3,181,274 | A | | 5/1965 | Izenour | |
| 3,609,898 | A | * | 10/1971 | Brown | 40/601 |
| 3,938,269 | A | * | 2/1976 | Catteau | 40/601 |
| 3,944,186 | A | | 3/1976 | Einhorn et al. | |
| 3,984,931 | A | | 10/1976 | Belokin, Jr. | |
| 4,034,491 | A | * | 7/1977 | Fisher et al. | 40/431 |
| 4,057,211 | A | | 11/1977 | Moore | |
| 4,187,996 | A | | 2/1980 | Ehrlich | |
| 4,434,570 | A | | 3/1984 | Roos | |
| 4,612,485 | A | * | 9/1986 | Suska | 318/15 |
| 4,682,822 | A | * | 7/1987 | Brecht et al. | 303/20 |
| 4,767,101 | A | | 8/1988 | Schweinberger | |
| 4,872,632 | A | | 10/1989 | Johnson | |
| 4,953,053 | A | * | 8/1990 | Pratt | 361/31 |
| 4,959,645 | A | * | 9/1990 | Balz | 340/825.72 |
| 5,088,219 | A | * | 2/1992 | Toraby-Payhan | 310/77 |
| 5,188,332 | A | | 2/1993 | Callas | |
| 5,245,496 | A | * | 9/1993 | Kim et al. | 361/30 |
| 5,287,109 | A | * | 2/1994 | Hesse | 341/176 |
| 5,381,991 | A | | 1/1995 | Stocker | |
| 5,409,191 | A | | 4/1995 | Wenmaekers | |
| 5,438,780 | A | | 8/1995 | Winner | |
| 5,438,798 | A | * | 8/1995 | Plamper et al. | 200/61.43 |
| 5,529,274 | A | * | 6/1996 | Anderson et al. | 40/601 X |
| 5,551,658 | A | * | 9/1996 | Dittmer | 248/329 |

* cited by examiner

*Primary Examiner*—Brian K. Green
(74) *Attorney, Agent, or Firm*—Wiggin and Dana LLP; Dale Lynn Carlson; Michael K. Kinney

(57) ABSTRACT

A remote-controlled motor-driven drum is provided to wind and unwind a cord which holds a self-balancing sign carrier. The sign carrier, which has telescoping rails, is adjustable in width. Its center rail includes two sheaves to receive the cord and lead it from the drum back to an end secured to the ceiling. Rotation of the drum raises and lowers the sign carrier and a sign carried by it. The sheaves on the carrier also serve to make the unit self-balancing. The motor responds to actuating signals for raising and lowering the sign and to safety features. Safety features include a limit switch which stops the motor when an object gets in the way, an overload control which stops the motor if excessive weight is detected, and the use of the motor for braking.

11 Claims, 10 Drawing Sheets

SIGN SUSPENSION SYSTEM

CROSS REFERENCE TO RELATED APPLICATION

This application is a continuation-in-part of application Ser. No. 08/408,934, filed Mar. 23, 1995 now U.S. Pat. No. 5,529,274, the contents of which is incorporated by reference herein in its entirety.

BACKGROUND OF THE INVENTION

This invention relates to a system for suspending signs, and more particularly to a system for suspending signs and for readily raising and lowering them. The system is useful in retail stores.

Often a retailer desires to hang, or change, a sign hanging from a particular location of his store. Often these signs are placed in locations readily viewable to consumers, such as near the ceiling. To hang or change a sign involves obtaining and using a ladder, or otherwise getting access to the ceiling area. Beyond the logistical problems of obtaining access, persons who either climb on the ladder or enter into the ceiling area encounter increased risk of injury.

There is a need for a suspension system for signs that does not require persons hanging or changing signs to reach the hanging location of the sign so that problems of access and injury are reduced.

SUMMARY OF THE INVENTION

Accordingly, the present invention is directed to a sign suspension system that substantially obviates one or more of the problems due to disadvantages and limitations of the prior art.

In accordance with the purpose of the invention, as embodied and broadly described, the invention utilizes a remote-controlled motor-driven drum as a winder, to wind and unwind a cord which is secured between a ceiling fixture and the drum and is holding a sign carrier. In an alternative embodiment, the loose end of the cord is secured to the extension of the motor operated drum unit. The sign carrier, which has telescoping rails, is adjustable in width, so as to hold different size signs. Its center rail includes two equally-spaced sheaves to receive the cord and lead it from the motor-driven drum to an end secured to the ceiling. Thus, motion of the drum serves to raise and lower the sign carrier and a sign carried by it. The equal spacing between the sheaves on the carrier and between the ceiling fixture exterior of the motor operated drum unit and the drum serve to make the unit self-balancing.

The user attaches a sign to the carrier wherein it is in its lowered position and then uses the motor to raise the sign and carrier to the ceiling. The motor, which is reversible, is remotely controlled either by wires leading between the motor and a switch, by radio control (with a control similar to that used on a garage door), or by using an infra red transmitter directed to an infra red receiver associated with the motor. Reversing the motor, of course, serves to lower the sign so that it can be replaced.

Safety features included are a limit switch at the motor unit, which stops and/or reverses the motor when an object gets in the way; a slip clutch which prevents overload of the motor; an overload control which stops the motor from raising the sign if excessive weight is detected; and use of the motor for braking.

It is to be understood that both the foregoing general description and the following detailed description are exemplary and are intended to provide further explanation of the invention as claimed.

The accompanying drawings are included to provide a further understanding of the invention and are incorporated in and constitute a part of this specification, and illustrate embodiments of the invention and together with the description, serve to explain the principles of the invention.

DETAILED DESCRIPTION OF THE INVENTION

Figure 1:
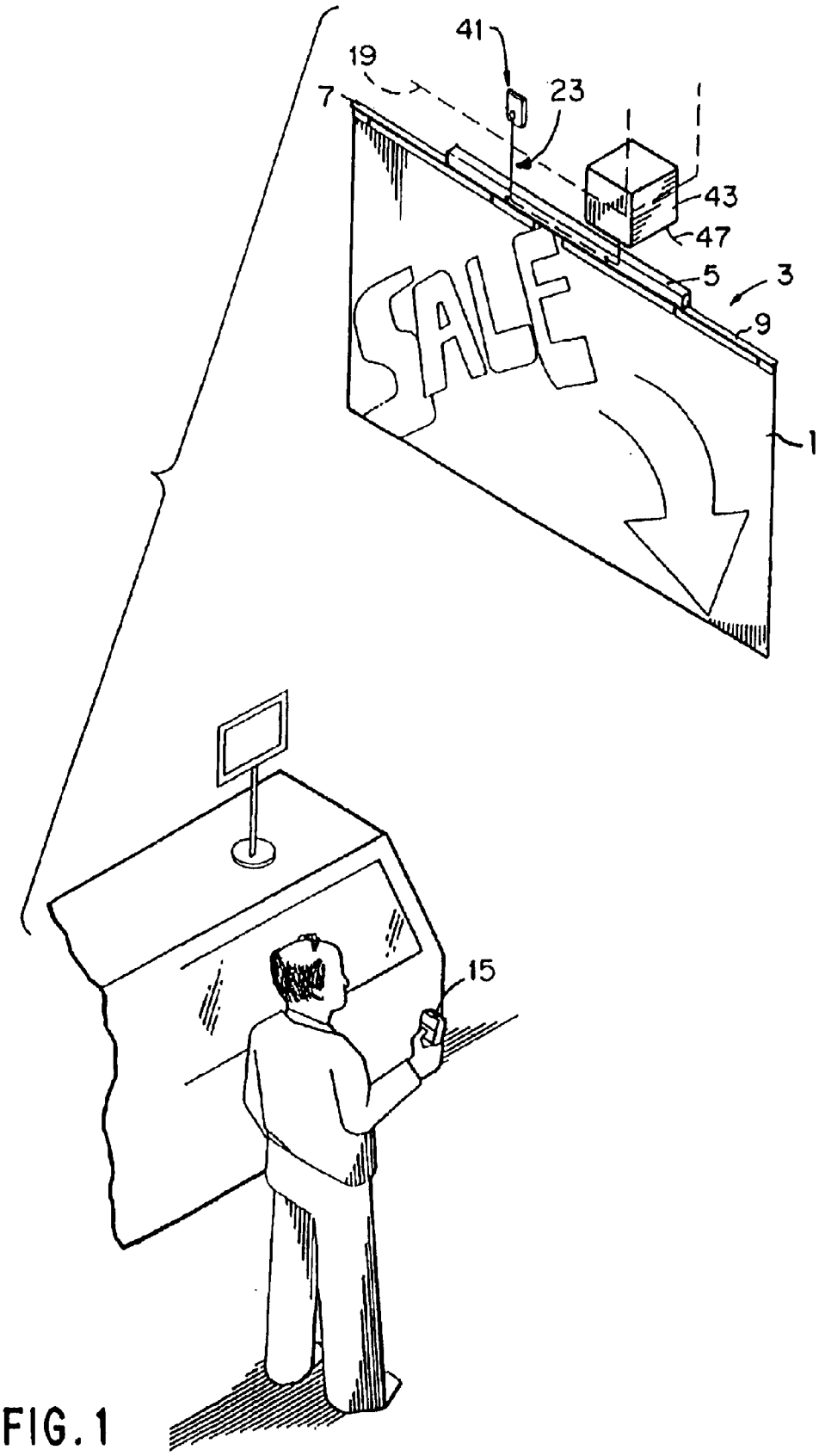
FIG. 1 illustrates the system for suspending a sign including a raised sign and a user, holding a remote control unit, below the sign.

A system for suspending a sign includes a sign, supporting rails, a cord, and a motor unit. As embodied herein and referring to FIG. 1, the system for suspending a sign includes the sign 1, the supporting rails 3, the cord 23, and the motor unit 43.

The supporting rails 3, that includes center main rail 5, frame 29, and side rails 7 and 9, support sign 1. The cord 23 threads from an attachment member 41 through center main rail 5 into motor unit 43. Motor unit 43 mounts to a support structure 19.

Figure 2:
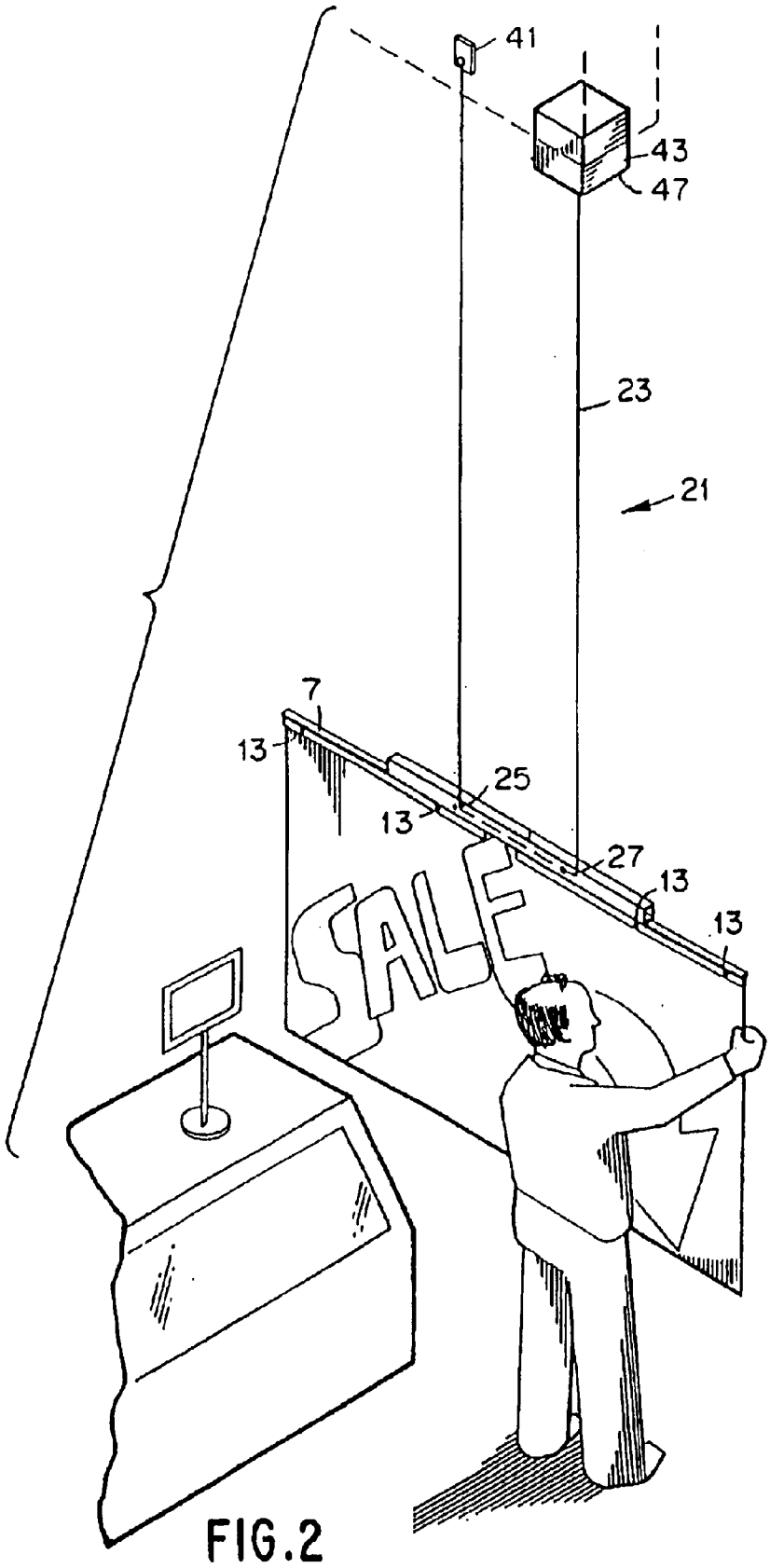
FIG. 2 illustrates the sign lowered so that the user can access the sign.

FIG. 2 illustrates the system of FIG. 1 in a down position, that is, the cord 23 extended from the motor unit 43 so that the sign 1 is lowered.

Figure 3:
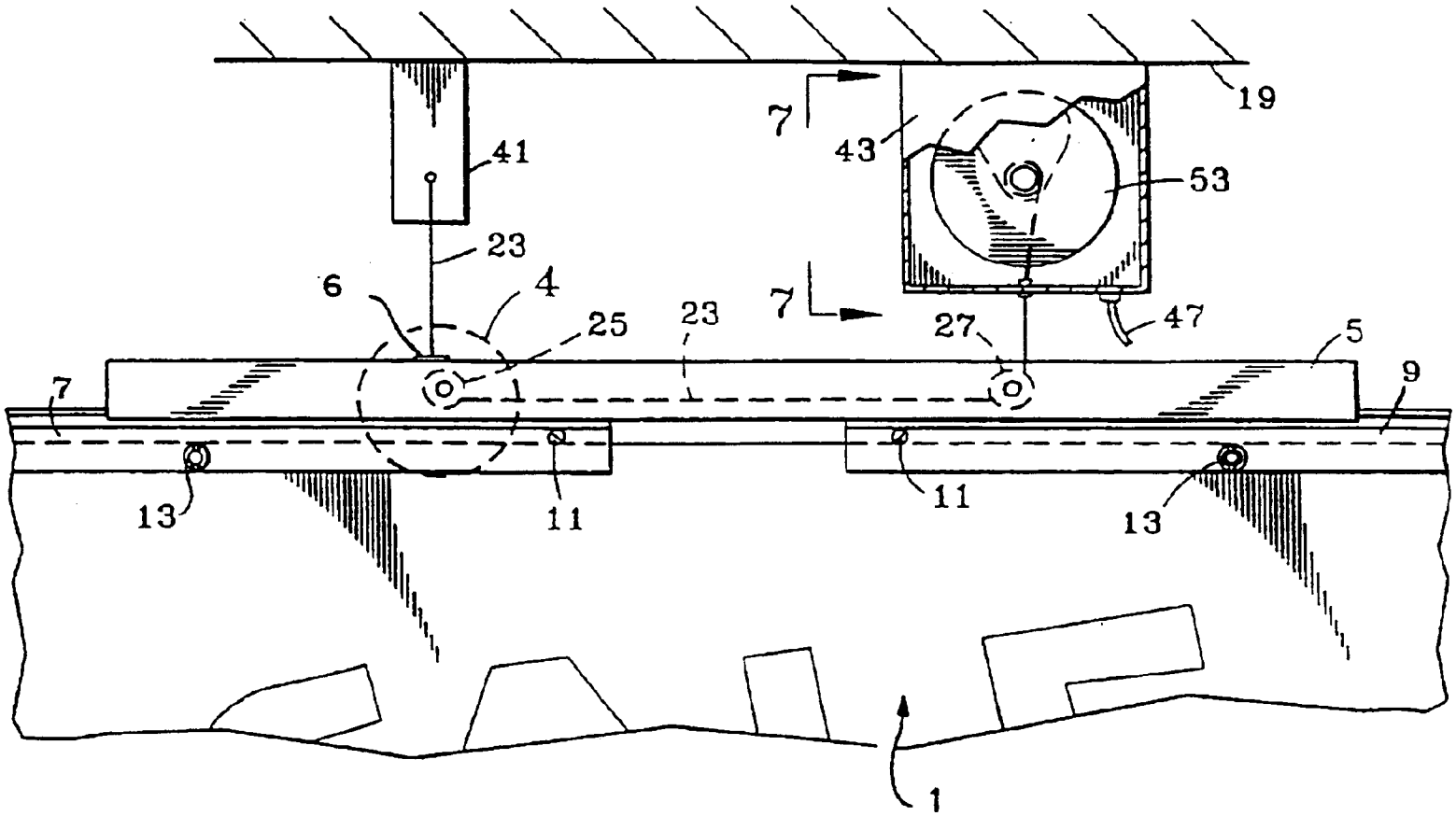
FIG. 3 illustrates details of the system of FIGS. 1 and 2.

FIG. 3 illustrates a detailed view of the sign 1 in an up position. The cord 23 extends from attachment member 41 through an opening 6 in center main rail 5 and around a sheave 25 to another sheave 27 and exits the center main rail 5. After exiting the center main rail 5, the cord 23 enters the motor unit 43 and attaches to a drum 53 located within motor unit 43.

Figure 4:
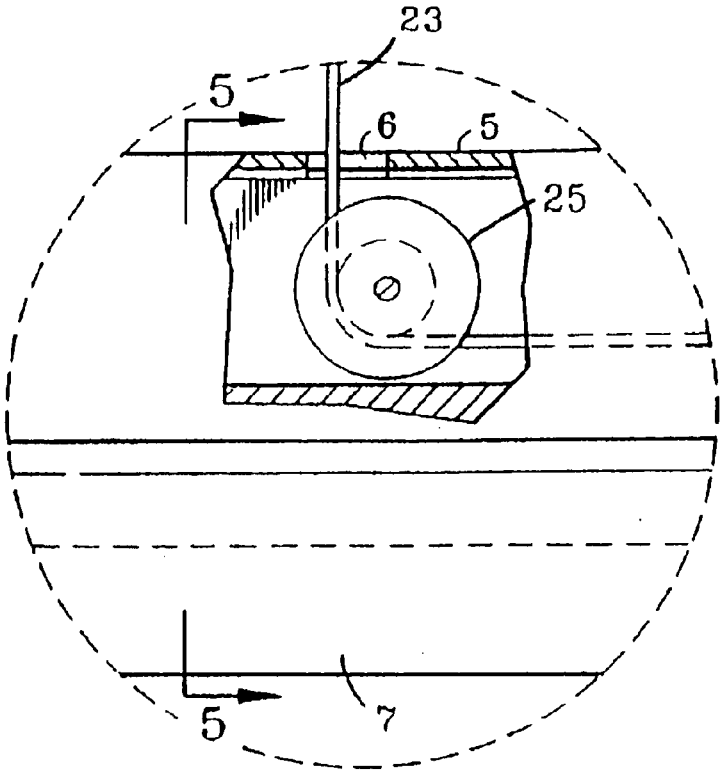
FIG. 4 illustrates an enlarged view of a portion one of the sheaves of FIG. 3.

FIG. 4 provides a detailed view of the sheave arrangement of FIG. 3. The cord 23 enters the opening 6 in center main rail 5, passes around the sheave 25, and travels to sheave 27, that has a similar configuration, but mirrored with respect to sheave 25.

Figure 5:
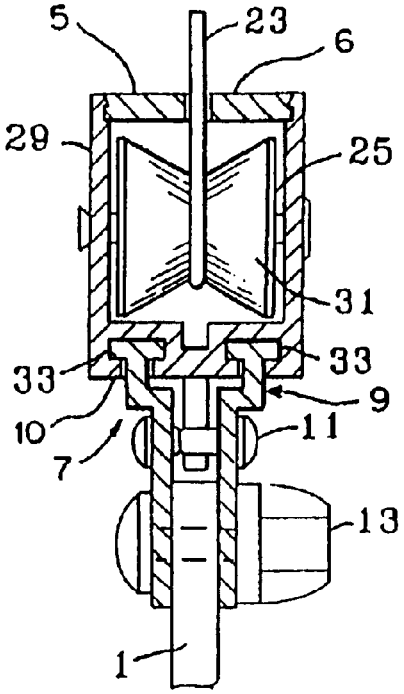
FIG. 5 illustrates a cross-section of the sheave of FIG. 4 along line 5—5 of FIG. 4.

FIG. 5 illustrates a section across line 5—5 of FIG. 4. The cord 23 passes through opening 6 and around a drum 31, that is part of sheave 25. Frame 29 provides a mounting location for drum 31. Slots 33 in frame 29 of rails 3 provide a location in which side rails 7 and 9 may slide. The side rails 7 and 9 have T-shaped members 10 which telescope into slots 33. Holding bolts 11 lock the T-shaped members 10 in position in frame 29 and thumb screws 13 hold sign 1 in the rails 7 and 9.

Figure 6:
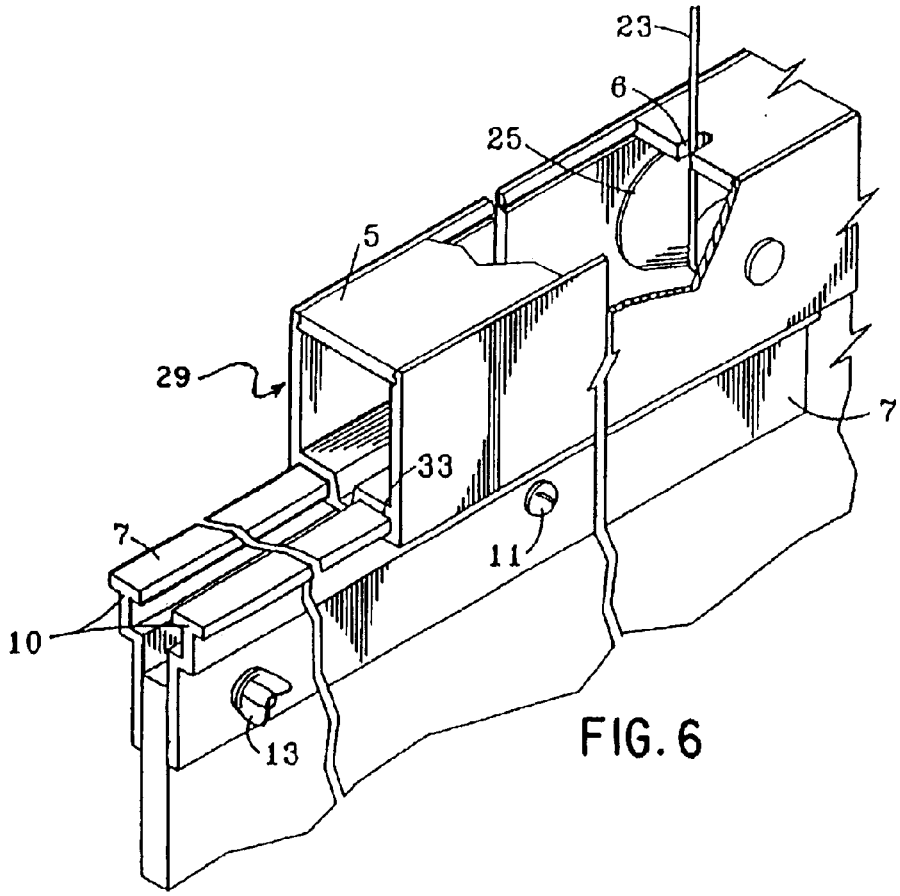
FIG. 6 illustrates a portion of the sign-carrying rails and of one of the associated sheaves of FIG. 1.

FIG. 6 provides another view of the portions just described showing how the T-shaped members 10 slideably attach into slots 33.

Figure 7:
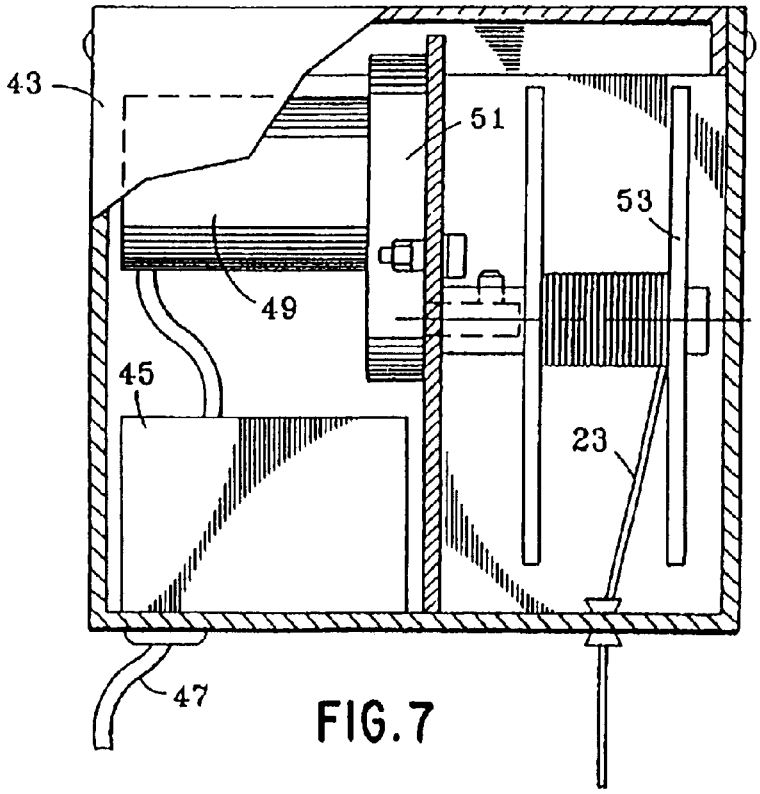
FIG. 7 illustrates a front elevation, partially broken away, of the motor-drum section FIG. 1.

FIG. 7 illustrates an end view of motor unit 43. A control unit 45 connects to a reversible motor 49. A reduction gear 51 connects reversible motor 49 to drum 53. An optional antenna 47 mounts to the bottom of the motor unit 47, although its actual placement is a design choice.

When hanging, attachment member 41 secures one end of the cord 23 while the other end is wrapped around drum 53 as illustrated in FIG. 3. Sheaves 25 and 27 are configured to be centered on the sign for self-balancing. The threading of the cord 23 around the sheaves 25 and 27 allow the sign 1 to maintain balance as the cord is extended out of and retracted into motor unit 43. Preferably, the spacing between the sheaves 25 and 27 is substantially the same as the spacing between the attachment member 41 and the drum 53, allowing the sign to balance more readily.

Figure 8:
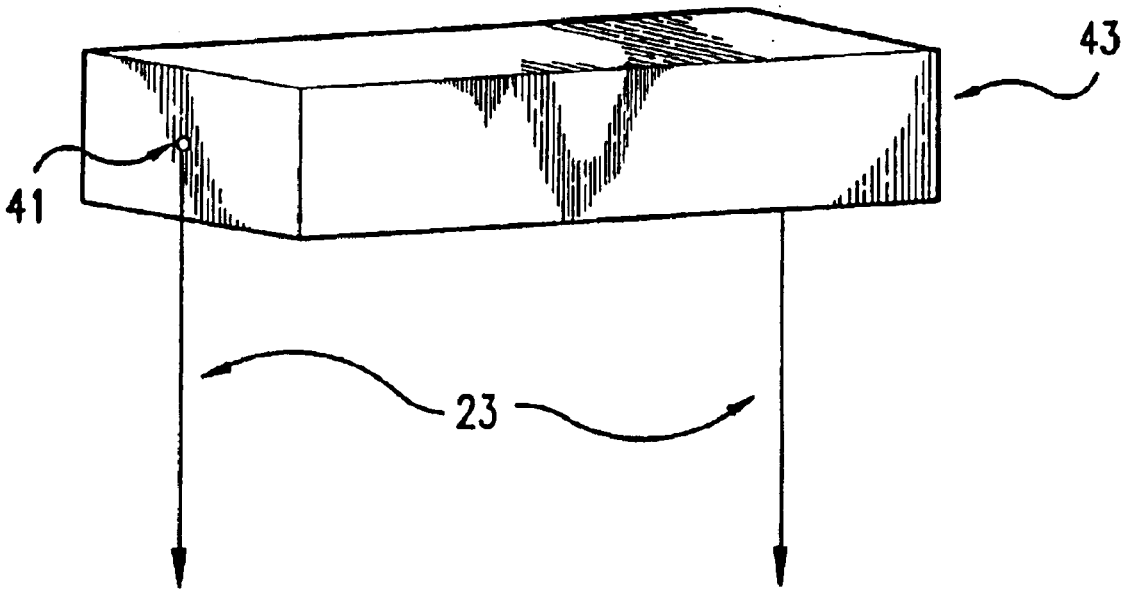
FIG. 8 illustrates an alternative embodiment of a motor-drum unit including an attachment point according to the present invention.

FIG. 8 illustrates an equally preferred embodiment in which attachment member 41 is located on motor unit 43. In this embodiment, motor unit 43 extends a length at least equal to the separation distance between sheaves 25 and 27. The specific location of attachment member 41 on motor unit 43 is a design choice, but the distance between the attachment member 41 and the point where cord 23 exits motor unit 43 is preferably equal to the distance between sheaves 25 and 27. Less preferred are distances that are not equal because they create horizontal stresses on the sheaves 25 and 27, the attachment point 41, and the exit location of cord 23 from the motor unit 43. FIG. 8 illustrates attachment member 41 located on one end of motor unit 43, however, equally preferred locations include the sides and the bottom of motor unit 43.

The user activates control circuit 45 (FIG. 7) with remote control unit 15 (FIG. 1) in combination with antenna 47 in a manner similar to radio-controlled garage doors. Alternatively, the control unit 15 can be wired directly to the control circuit 45, or be operated by an infra-red signalling system. Preferably, the control unit 15 has at least buttons for off, forward, and reverse.

In operation, the user activates the motor 49 to rotate drum 53 to extend the cord 23, lowering the rails 3 from the ceiling. The user adjusts main rail 5 and side rails 7 and 9 to provide a total length equal to the width of the sign 1 to be displayed (with side rails 7 and 9 being extended equal amounts) and then tightens the holding bolts 11. The user inserts the sign 1 between the rail sections, threads thumb screws 13 through the sign and tightens them. The user then operates motor 49 in the opposite direction, causing the motor to rotate drum 53 so that the cord 23 wraps around drum 53, and thus raising the sign 1. The sign self-balances and hangs horizontally at any desired height.

Figure 9:
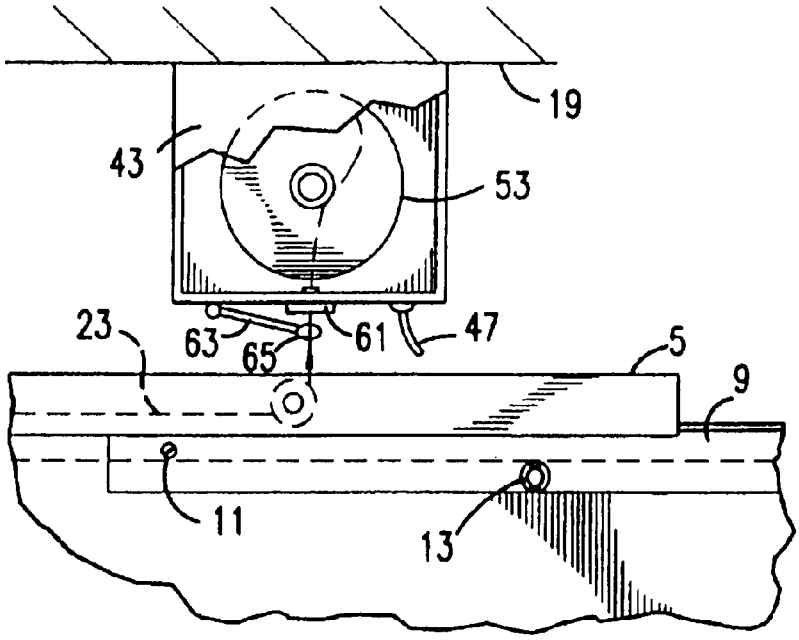
FIG. 9 illustrates an enlarged portion of FIG. 3 including a limit switch.

A limit switch 61, illustrated in FIG. 9, is preferably positioned on the lower surface of the motor unit 43, proximate to cord 23. An arm 63 pivotally connects to the motor unit 43 and carries a ring or loop 65 which surrounds the cord 23. When the arm 63 is moved upwardly by a user's hand inadvertently getting in the way or by the top of the sign 1 or the rails 3, arm 63 actuates the limit switch 61 and reverses the motor 49.

The limit switch 61 serves two purposes: it will prevent the user's hand from being accidently caught up on and torn by the cord 23 (carrying the sign); and it prevents the sign 1 and the rails 3 from hitting the motor unit 43. When actuated, the motor 49 instantly reverses and extends the cord 23 about one foot. Alternatively, the limit switch 61 causes motor 49 to stop instead of reversing direction.

Figure 10:
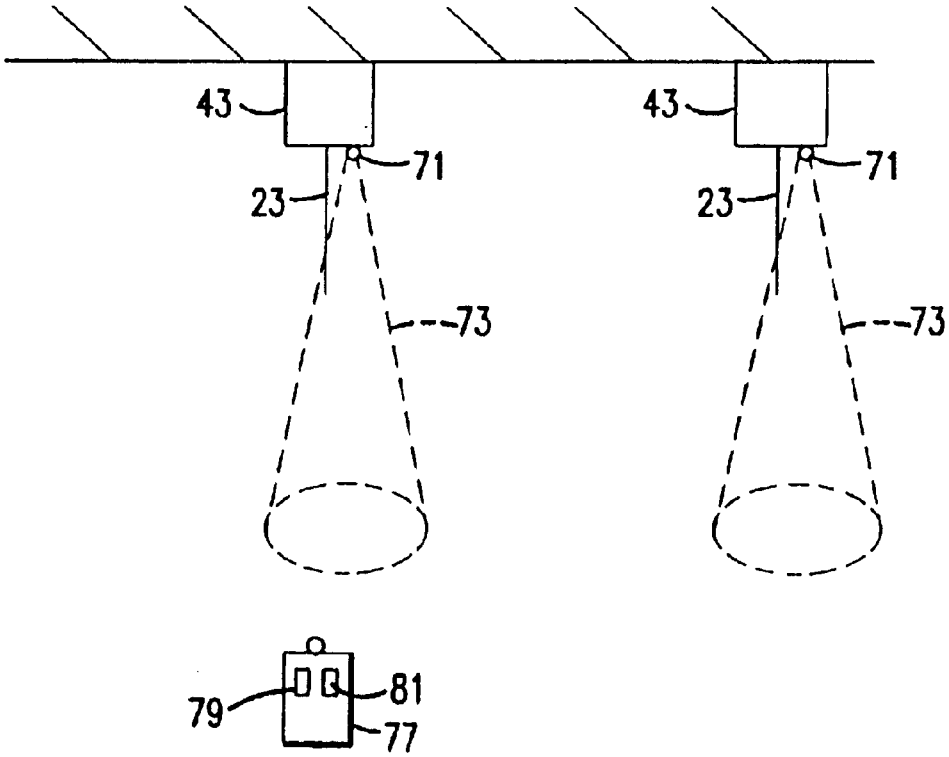
FIG. 10 illustrates a plurality of motor-drum units of FIG. 1 controlled by a remote control within a limited cone of reception.

FIG. 10 illustrates an infra red control system, that can separately control one or more suspended signs 1. FIG. 10 illustrates two such sign suspension systems. Each of the motor units 43 preferably carries an infra red detector 71 on its lower surface. Preferably, the detectors receive only within a limited cone of reception 73. The cone of reception 73 is preferably centered about a vertical axis and can be dimensioned such that it has a radius of about ten feet at a distance from the detector approximating the level at which the operator will hold the actuating infra red transmitter 77 from the motor unit 43. Thus, for example, if the motor unit is mounted to a ceiling fifteen feet high and the operator holds the transmitter at approximately chest level (three feet from the floor), then the cone should preferably have a ten foot radius at about twelve feet from the detector 71. Infra red transmitter 77 is preferably a directional transmitter. As a result, the user can readily control one sign at a time by holding the transmitter within the cone of reception 73 of the desired sign and aiming it at the detector 71 on that sign. The transmitter should have a coded beam, i.e., sending one code to operate the motor in forward and a different code to operate the motor in reverse, the codes being selected by pressing either a forward button 79 or a reverse button 81 on infra red transmitter 77 as illustrated in FIG. 10.

Figure 11:
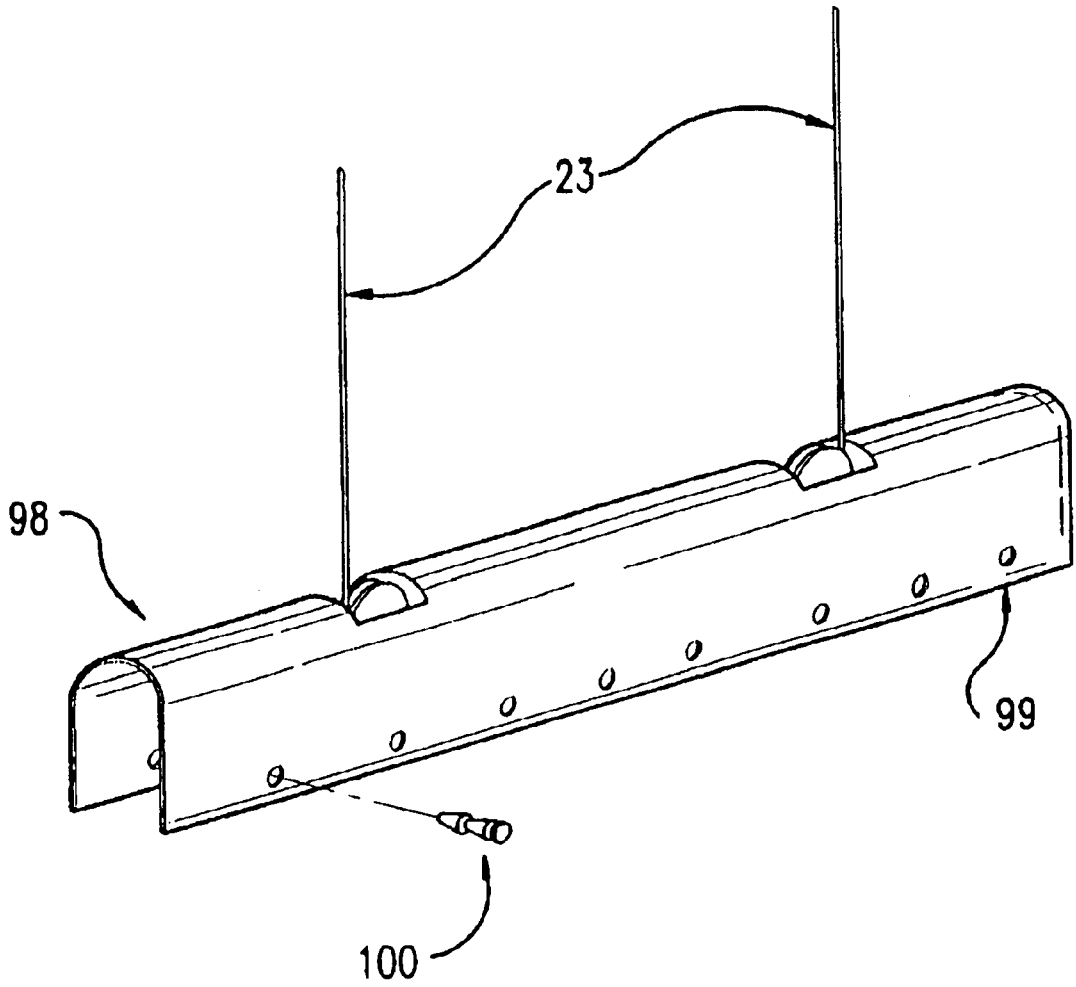
FIG. 11 illustrates an alternative embodiment of a sign support according to the present invention.

FIG. 11 illustrates another preferred embodiment for supporting the sign 1. In this embodiment, sheaves 25 and 27 are mounted on a supporting member 98. Supporting member 98 is a generally upside down U-shaped member having a plurality of pairs of holes 99 in the extending sides of the U-shape, each pair consists of one hole on one side and a corresponding hole on the other side. A user inserts sign 1 into the U-shape and inserts a clip 100 into each of the holes on one side so that they extend through to the other side to secure the sign 1.

Supporting member 98 is preferably aluminum or plastic and made by extrusion. Any material effective to provide support to a sign is also preferred and may be made by any manufacturing process.

Clips 100 are preferably a dart clip or a christmas tree clip, but may be any type of clip effective to extend through the U-shape and secure the sign 1 to the supporting member 98. One skilled in the art would recognize many equivalents of this type of clip.

Figure 12:
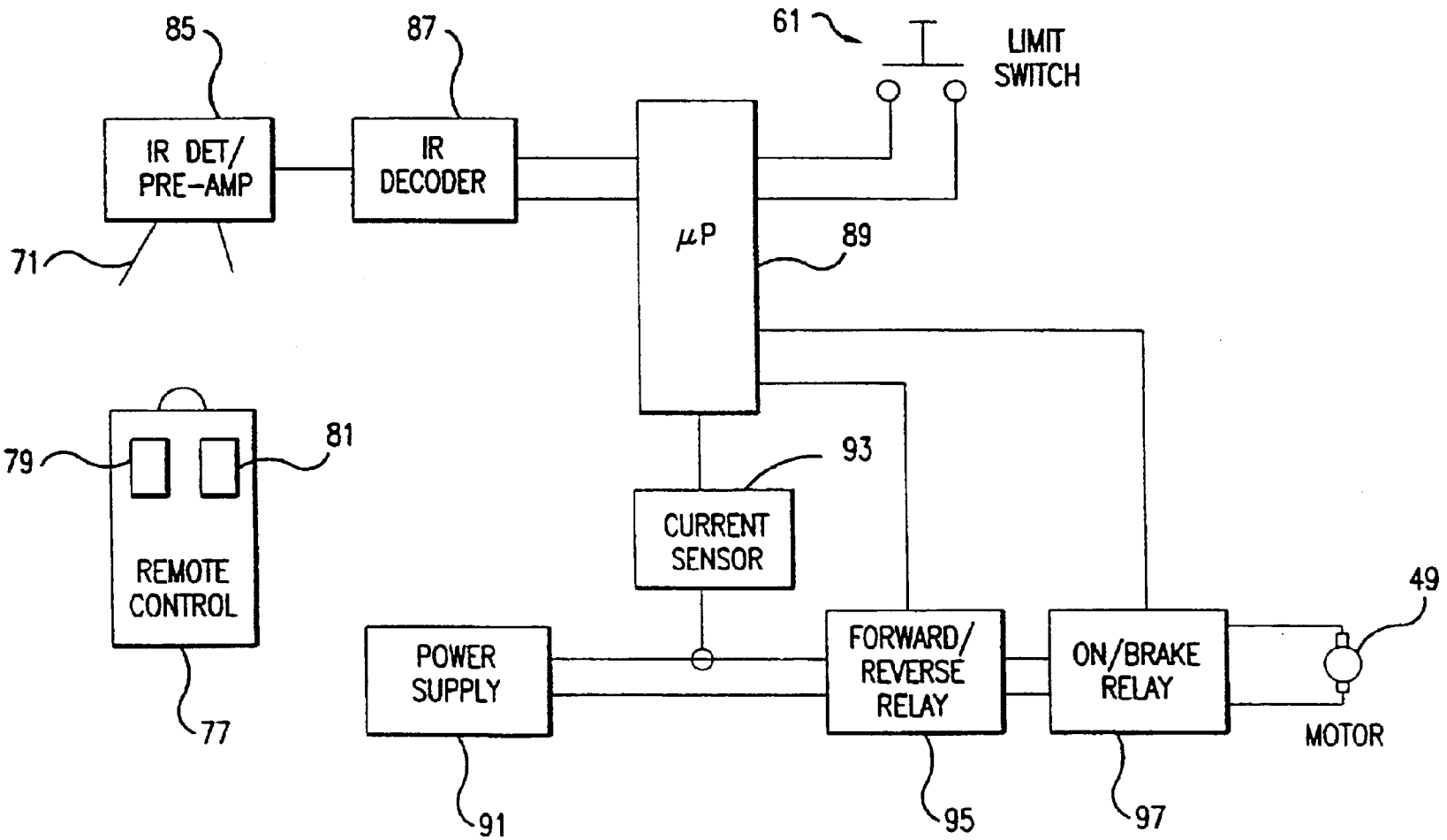
FIG. 12 illustrates a block diagram of the motor-drum unit.

FIG. 12 presents a block diagram of a portion of the system according to the invention and includes a microprocessor, current sensors, a power supply, forward/reverse relays, an on/brake relay, an infra red (IR) decoder, a detector pre-amplifier, a limit switch, a remote control unit, and a motor. As embodied herein and referring to FIG. 10, this portion includes microprocessor 89, current sensors 93, a power supply 91, forward/reverse relays 95, an on/brake relay 97, an IR decoder 87, a detector/pre-amplifier 85, limit switch 61, remote control unit 77, and motor 49.

The IR detector/pre-amplifier 85 connects to the IR decoder 87 that in turn connects to the microprocessor 89. Limit switch 61, on/brake relay 97, forward/reverse relay 95, and current sensor 93 also connect to microprocessor 89. Power supply 91 connects to forward/reverse relay 95 and to current sensor 93. Forward/reverse relay 95 connects to on/brake relay 97 that in turn connects to motor 49.

To raise or lower a sign, a user presses the forward 79 or reverse 81 button on infra transmitter 77, sending a directional beam of infra red light, encoded for either forward or reverse, to the infra red detector 71 at the motor-operated drum unit 43. The IR detector/pre-amplifier detects and amplifies the signal and passes it to IR decoder 87. IR decoder 87 determines whether the signal indicates forward or reverse and passes the determination to microprocessor 89. The microprocessor 89 then sends the appropriate signals to the forward/reverse relay 95 and to the on/brake relay 97, resulting in operation of the motor 49 in the desired direction.

Although illustrated as infra red, equally preferred is any type of signalling system that can communicate forward or reverse to the motor unit 43.

Power supply 91 provides power for motor 49 through the forward/reverse relay 95 and the on/brake relay 97.

When relay 97 acts as a brake, it electronically shorts the motor 49 terminals together, causing the motor 49 to brake and increase the holding power in the stop mode.

Current sensor 93 detects the amount of current passing from the power supply 91 to the motor 49 and sends a corresponding signal to the microprocessor 89. If the sign 1 is too heavy or someone pulls on the sign while it is being lifted, an overload is detected and the microprocessor 89 instantly stops the motor 49. The motor 49 will not then move in the up direction until it is reversed for a moment to reset the circuitry. The extent of overload required to actuate this feature can be adjusted for sign weight such that any amount over this adjustment will trip the overload feature. Preferably, the range for the sign weight is from about 2 pounds to about 10 pounds. The actual weight, however, is not critical to understanding the operation of the invention, since it may be adjusted for any desired weight.

The limit switch 61, described above with reference to FIG. 8, is also connected to the microprocessor 89, and additionally controls the motor 49. When the limit switch 61 is actuated, the motor reverses direction for a moment, preferably 600 milliseconds, and stops. A user must release whichever button was pressed before the motor 49 can be operated again.

Figure 13:
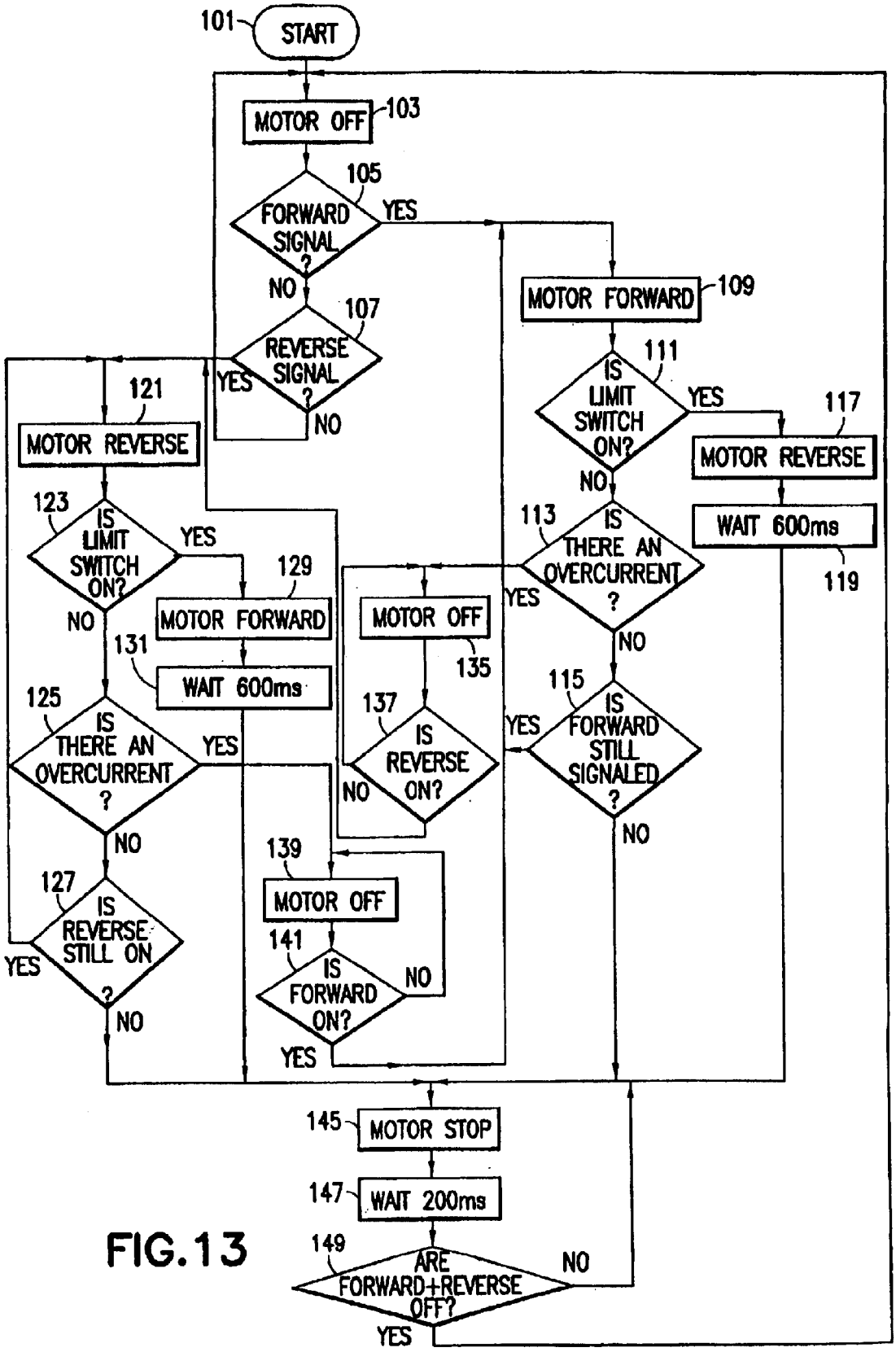
FIG. 13 illustrates a flow chart showing the operating cycle of the invention.

FIG. 13 illustrates the flow chart of the operation of the sign suspension system including its protective features, preferably, under the control of microprocessor 89. Initially, at the start 101, the motor is off. At block 103, the motor is off and the system waits for a signal from control 77. The system moves to decision block 105 and checks for a forward signal. If the determination is yes, a forward signal is present and the system moves to block 109 and activates motor 49 in the forward direction to extend the cord 23. Since the drum 53 is continuous, if for some reason, the user extends the cord 23 past its maximum, then the motor will be operating in a forward direction but the cord 23 begin to wrap around the drum 53 and start retracting. Thus, the operation according to the flow chart in FIG. 13 operates in a similar manner whether the cord is extending or retracting when the motor is operating in the forward direction. For the purposes of this description, it is assumed that forward initially operates the motor to extend the cord 23.

The system then moves to decision block 111 and checks the position of the limit switch 61. If the limit switch 61 is on, then the system moves to block 117 and reverses the motor 49 to extend the cord 23. In this instance, forward was retracting the cord 23. The system moves to block 119 and waits 600 ms, allowing the motor 49 to extend about a foot of cord 23. After 600 ms, the system moves to block 145 and stops the motor 49. After waiting 200 ms in block 147, the system checks to determine whether both the forward button 79 and the reverse button 81 are off. If the determination is no, then the system loops back to block 145. If the determination is yes, then the system loops back to block 103.

If, at decision block 111, the system determines that the limit switch 61 is off, then the system passes to decision block 113 and determines whether an overcurrent situation is present. If no, then the system passes to decision block 115 and determines whether the forward button 79 is still on. If no, the system passes to block 145 and control occurs as described above. If yes, the system passes to block 109 and control occurs as described above.

If the system determines in decision block 113 that an overcurrent situation is present, the system passes to block 135 and stops the motor 49. The system then passes to decision block 137 and determines whether the reverse button 81 is on. If the reverse button 81 is off, the system loops back to block 135 and continues looping until the reverse button 81 is pressed. If the system determines that reverse button 81 is on in decision block 137, the system passes to block 121 and activates the motor 49 to extend the cord 23. The system then determines whether the limit switch 61 is on in decision block 123. If the limit switch 61 is on, the system passes to block 129 and reverses the motor 49. The system then passes to block 131 and waits for 600 ms, allowing the motor to extend the cord 23 about one foot. After waiting the 600 ms the system passes to block 145 and continues as described above. Even if the cord is extended to the maximum and rewinds in the opposite direction on the rotating drum 53 all safety features remain unchanged. Cord 23 will still extend when the limit switch 61 is activated.

If the system determines at decision block 123 that the limit switch 61 is not on, then the system passes to decision block 125 where it checks to determine whether an overcurrent situation is present. If an overcurrent situation is present, the system passes to block 139 and stops the motor 49. After stopping the motor 49, the system passes to decision block 141 to determine whether the forward button 79 has been pressed. If not, then the system loops back to block 139 and continues looping until the forward button 79 is pressed. Once the system determines in decision block 141 that forward button has been pressed, it moves to block 109 and progresses as described above.

If the system determines at decision block 125 that an overcurrent situation is not present, then the system moves to decision block 127 and determines whether the reverse button 81 is still on. If the system determines that the reverse button 81 is off, then the system passes to block 145 and continues as described above. If the system determines that the reverse button 81 is still on, then the system returns to block 121 and continues as described above.

If the system determines in decision block 105 that the forward button 79 is not on, then the system passes to decision block 107 and determines whether the reverse button 81 has been pressed. If the reverse button 81 has not been pressed, then the system loops back to block 103 and continues as described above. If the system determines that the reverse button 81 has been pressed, then the system passes to block 121 and continues as described above.

Those skilled in the art will immediately realize various modifications and variations that can be made to the sign suspension system of the present invention without departing from the spirit and scope of the invention. Thus, it is intended that the present invention cover the modifications and variations of this invention provided that they come within the scope of the appended claims and their equivalents.

What is claimed is:

1. A system for suspending a sign, comprising:

a member for supporting said sign;

a cord supporting said member;

a motor unit having a reversible motor and a drum operated by said reversible motor, said motor unit engaging said cord such that said cord is wound around said drum for raising and lowering said sign;

a switch, coupled to said motor unit, for providing first output control signals when an object contacts said switch;

a motor control unit, coupled to said reversible motor, for controlling bi-directional rotation of said reversible motor, said motor control unit comprising:

a detector, responsive to received actuating signals, for providing second output control signals;

a sensor for detecting an overload condition on the reversible motor and for providing third output control signals;

a forward-reverse relay;

an on-brake relay; and a microprocessor, coupled to said switch, said detector, said sensor, said forward-reverse relay and said on-brake relay, said microprocessor receives said first, second and third output control signals and activates said forward-reverse and said on-brake relays to control said bi-directional rotation of said reversible motor; and a signal generating transmitter, physically separated from said motor control unit, for transmitting said actuating signals to said detector;

wherein in response to said first output control signals, said motor control unit controls said reversible motor to reverse a first direction and operate in a second direction reversed to said first direction for a predetermined time period before stopping;

wherein in response to said second output control signals, said motor control unit controls said reversible motor to operate in one of said first direction, said second direction and to terminate vertical motion of said sign;

wherein in response to said third output control signals, said motor control unit controls said reversible motor to terminate vertical motion of said sign.

2. The system as claimed in claim 1 wherein said on-brake relay operates to stop said reversible motor by electronically shorting terminals of said reversible motor causing said reversible motor to brake and increase holding power when stopped.

3. The system as claimed in claim 1 further comprising:

a plurality of motor units each at different locations; and a plurality of signs; wherein each of the signs mounts a corresponding motor unit.

4. The system as claimed in claim 1 wherein the sensor includes means for determining the magnitude of a load that triggers said overload condition.

5. The system as claimed in claim 1 wherein the detector is an infra red detector.

6. The system as claimed in claim 5 wherein the infra red detector is responsive to signals received within a predetermined field of reception.

7. The system as claimed in claim 1 wherein the signal generating transmitter generates and transmits infra red actuating signals.

8. The system as claimed in claim 1 further comprising:

a reduction gear connecting the reversible motor to the drum.

9. The system as claimed in claim 1 wherein said predetermined time period comprises a time period of about 600 ms.

10. The system as claimed in claim 1 wherein said predetermined time period comprises a time period for operating said reversible motor in said reversed direction such that said sign travels a predetermined safe distance from said object.

11. The system as claimed in claim 10 wherein said predetermined safe distance is about one foot.

* * * * *